US007303848B2

(12) United States Patent
Hill et al.

(10) Patent No.: US 7,303,848 B2
(45) Date of Patent: Dec. 4, 2007

(54) LIQUID TONERS COMPRISING AMPHIPATHIC COPOLYMERIC BINDER AND SOLUBLE POLYMERS FOR ELECTROGRAPHIC APPLICATIONS

(75) Inventors: Susan E. Hill, Woodbury, MN (US); Gay L. Herman, Cottage Grove, MN (US); James A. Baker, Hudson, WI (US)

(73) Assignee: Samsung Electronics Company, Suwon (KR)

( * ) Notice: Subject to any disclaimer, the term of this patent is extended or adjusted under 35 U.S.C. 154(b) by 345 days.

(21) Appl. No.: 10/975,527

(22) Filed: Oct. 28, 2004

(65) Prior Publication Data

US 2006/0093948 A1 May 4, 2006

(51) Int. Cl.
*G03G 9/13* (2006.01)

(52) U.S. Cl. ..... 430/115; 430/114

(58) Field of Classification Search ..... 430/115, 430/114

See application file for complete search history.

(56) References Cited

U.S. PATENT DOCUMENTS

| | | | | |
|---|---|---|---|---|
| 4,229,513 | A | 10/1980 | Merrill et al. | |
| 4,547,449 | A | 10/1985 | Alexandrovich et al. | |
| 4,762,764 | A * | 8/1988 | Ng et al. | 430/115 |
| 4,978,598 | A | 12/1990 | Elmasry et al. | |
| 4,988,602 | A | 1/1991 | Jongewaard et al. | |
| 5,066,559 | A | 11/1991 | Elmasry et al. | |
| 5,106,717 | A | 4/1992 | Houle et al. | |
| 5,112,718 | A | 5/1992 | Kato et al. | |
| 5,254,425 | A | 10/1993 | Suzuki et al. | |
| 5,342,725 | A | 8/1994 | Kato | |
| 5,482,809 | A | 1/1996 | Rao et al. | |
| 5,484,679 | A | 1/1996 | Spiewak et al. | |
| 5,525,448 | A | 6/1996 | Larson et al. | |
| 5,532,099 | A | 7/1996 | Horie et al. | |
| 5,604,070 | A | 2/1997 | Rao et al. | |
| 5,652,282 | A | 7/1997 | Baker et al. | |
| 5,698,616 | A | 12/1997 | Baker et al. | |
| 5,886,067 | A | 3/1999 | Li et al. | |
| 6,087,416 | A * | 7/2000 | Pearlstine et al. | 523/160 |
| 6,103,781 | A | 8/2000 | Li et al. | |
| 6,255,363 | B1 | 7/2001 | Baker et al. | |
| 7,060,408 | B2 * | 6/2006 | Qian et al. | 430/114 |
| 2003/0134940 | A1 | 7/2003 | Morrison et al. | |
| 2005/0095524 | A1 * | 5/2005 | Qian et al. | 430/114 |
| 2005/0160938 | A1 * | 7/2005 | Moudry et al. | 106/31.87 |
| 2006/0099715 | A1 * | 5/2006 | Munoz et al. | 436/151 |

FOREIGN PATENT DOCUMENTS

| | | |
|---|---|---|
| WO | WO 01/79363 A2 | 10/2001 |
| WO | WO 01/79364 A2 | 10/2001 |

* cited by examiner

*Primary Examiner*—Christopher RoDee
*Assistant Examiner*—Peter L. Vajda
(74) *Attorney, Agent, or Firm*—Kagan Binder, PLLC

(57) ABSTRACT

The invention provides liquid electrographic toner compositions comprising a liquid carrier having toner particles and at least one soluble polymer dispersed in the liquid carrier. The liquid carrier has a Kauri-Butanol number less than about 30 mL. The toner particles comprise polymeric binder comprising at least one amphipathic copolymer comprising one or more S material portions and one or more D material portions. The soluble polymer is present in an amount of from about 1% to about 10% by weight based on toner particle weight. The absolute difference in Hildebrand solubility parameters between the soluble polymer and the liquid carrier is less than about 3.0 $MPa^{1/2}$. In one aspect of the invention, the soluble polymer that is incorporated in the toner composition has no more than about 30% weight ratio chemical constitution variance from the chemical constitution of the S material portion of the amphipathic copolymer.

23 Claims, No Drawings

LIQUID TONERS COMPRISING AMPHIPATHIC COPOLYMERIC BINDER AND SOLUBLE POLYMERS FOR ELECTROGRAPHIC APPLICATIONS

FIELD OF THE INVENTION

The present invention relates to liquid toner compositions having utility in electrography. More particularly, the invention relates to liquid toner compositions comprising an amphipathic copolymer binder and a soluble polymer in a liquid carrier.

BACKGROUND OF THE INVENTION

In electrophotographic and electrostatic printing processes (collectively electrographic processes), an electrostatic image is formed on the surface of a photoreceptive element or dielectric element, respectively. The photoreceptive element or dielectric element can be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227-252, and U.S. Pat. Nos. 4,728,983, 4,321,404, and 4,268,598.

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which can also be referred to as "light," can include infrared radiation, visible light, and ultraviolet radiation, for example.

In the development step, toner particles of the appropriate polarity are generally brought into contact with the latent image on the photoreceptor, typically using a developer electrically-biased to a potential having the same polarity as the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative surface energies between the ink, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer can be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Electrophotographic imaging processes can also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

A single-pass electrophotographic process for developing multiple color images is also known and can be referred to as a tandem process. A tandem color imaging process is discussed, for example in U.S. Pat. No. 5,916,718 and U.S. Pat. No. 5,420,676. In a tandem process, the photoreceptor accepts color from developer stations that are spaced from each other in such a way that only a single pass of the photoreceptor results in application of all of the desired colors thereon.

Alternatively, electrophotographic imaging processes can be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227-252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30°-C and volume mean particle diameter between 0.1-1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68-74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40°-C and volume mean particle diameter between 3-10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

The art continually searches for improved liquid toner compositions that are storage stable and that produce high quality, durable images on a final image receptor.

SUMMARY OF THE INVENTION

The present invention relates to liquid electrographic toner compositions comprising a liquid carrier having toner particles and at least one soluble polymer dispersed in the liquid carrier. The liquid carrier has a Kauri-Butanol number less than about 30 mL. The toner particles comprise polymeric binder comprising at least one amphipathic copolymer comprising one or more S material portions and one or more D material portions. The soluble polymer is present in an amount of from about 1% to about 10% by weight based on toner particle weight. The absolute difference in Hildebrand solubility parameters between the soluble polymer and the liquid carrier is less than about 3.0 $MPa^{1/2}$. In one aspect of the invention, the soluble polymer that is incorporated in the toner composition has no more than about 30% weight ratio chemical constitution variance from the chemical constitution of the S material portion of the amphipathic copolymer. In another aspect of the invention, the soluble polymer that is incorporated in the toner composition has no acidic functionality having a pKa greater than 8, and has no basic functionality having a pKa of its conjugate acid that is greater than 8.

Amphipathic polymers have previously been used in liquid toner compositions, with the perceived benefit that the toner compositions made using amphipathic polymers do not require the use of additional dispersing aids to maintain a dispersion of the toner particles in the liquid carrier. Surprisingly, it has been found that the addition of a soluble polymer having the characteristics as described above to toner compositions comprising amphipathic copolymer-based toner particles improves the redispersiblity of the ink during the aging process. In toner compositions of the present invention, it has been found that toner particles tend to settle out of solution less when the composition includes soluble polymers as described herein. Additionally, toner compositions of the present invention rapidly become fluid during mixing. Surprisingly, the addition of the soluble polymer does not have an adverse affect on the viscosity of the liquid toner composition. An additional advantage of this soluble polymer additive is that there is no detrimental effect on print quality caused by addition of the soluble polymer. In fact, an increase in optical density of the resulting image has been observed in toner compositions of the present invention, especially in yellow toners.

In a preferred embodiment, the soluble polymer has no more than about 20%, and more preferably has no more than about 10% weight ratio chemical constitution variance from the chemical constitution of the S material portion of the amphipathic copolymer. In a particularly preferred embodiment of the present invention, the difference between the molecular weight of the soluble polymer and of the S material portion of the amphipathic copolymer is no more than about 50%, more preferably no more than about 30%, and most preferably no more than about 10% (hereinafter the "molecular weight variance"). In a particularly preferred embodiment, the soluble polymer and the S material portion of the amphipathic copolymer have no more than about a 30% weight ratio chemical constitution variance and no more than about a 50% molecular weight variance. In this aspect of the invention, the close structural nature of the soluble polymer to the S material portion of the amphipathic copolymer surprisingly provides benefit in dispersibility, stability and print quality of the ultimate toner composition, despite not being of the traditional chemical form of dispersion additives.

In another other aspect of the present invention, it is surprisingly advantageous to incorporate soluble polymer that has no acidic functionality having a pKa greater than 8 and no basic functionality having a pKa of its conjugate acid that is greater than 8. In this aspect of the invention, the incorporation of such soluble polymers surprisingly provides benefit in dispersibility, stability and print quality of the ultimate toner composition, despite not having strongly acidic or basic functionality that would have been expected to be important to achieving coordination with the toner particle. In a particularly preferred embodiment of the present invention, the amphipathic copolymer additionally has no acidic functionality having a pKa greater than 8, and has no basic functionality having a pKa of its conjugate acid that is greater than 8. It is particularly surprising that this embodiment, which does not provide acidic or basic coordinating functionality on the amphipathic copolymer, still provides a toner composition that provides benefit in dispersibility, stability and print quality of the ultimate toner composition.

DETAILED DESCRIPTION OF PRESENTLY PREFERRED EMBODIMENTS

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

The toner particles of the liquid toner composition comprise a polymeric binder that comprises an amphipathic copolymer. As used herein, the term "amphipathic" refers to a copolymer having a combination of portions having distinct solubility and dispersibility characteristics in a desired liquid carrier that is used to make the organosol and/or used in the course of preparing the liquid toner particles. Preferably, the liquid carrier is selected such that at least one portion (also referred to herein as S material or portion(s)) of the copolymer is more solvated by the carrier while at least one other portion (also referred to herein as D material or portion(s)) of the copolymer constitutes more of a dispersed phase in the carrier. Preferred amphipathic copolymers are prepared by first preparing an intermediate S material portion comprising reactive functionality by a polymerization process, and subsequently reacting the available reactive functionalities with a graft anchoring compound. The graft anchoring compound comprises a first functionality that can be reacted with the reactive functionality on the intermediate S material portion, and a second functionality that is a polymerizably reactive functionality that can take part in a polymerization reaction. After reaction of the intermediate S material portion with the graft anchoring compound, a polymerization reaction with selected monomers can be carried out in the presence of the S material portion to form a D material portion having one or more S material portions grafted thereto.

The soluble polymer used in compositions of the present invention can be of any material providing appropriate solubility characteristics in the liquid carrier as discussed herein. The soluble polymer preferably is a polymer prepared by a free radical polymerization process. Preferably, the absolute difference in Hildebrand solubility parameters between the soluble polymer and the liquid carrier is less than about 2.0 $MPa^{1/2}$ and more preferably less than about 1.5 $MPa^{1/2}$. In another preferred embodiment, the absolute difference in Hildebrand solubility parameters between the soluble polymer and the liquid carrier is from about 2 to about 3.0 $MPa^{1/2}$.

The soluble polymer used in the present toner compositions preferably does not contribute to tackiness of the toner composition in a manner that adversely affects transfer of an image or durability of an image formed from the toner composition. Preferably the soluble polymer has a $T_g$ of at least about 30° C. In another embodiment, the soluble polymer has a $T_g$ of at least about 45° C. or of at least about 60° C.

The soluble polymer used in the present toner compositions preferably has a molecular weight of from about 10,000 to 1,000,000, and more preferably from about 50,000 to about 500,000 Daltons.

Preferably, the soluble polymer is of the same general class of material as the S material portion of the amphipathic copolymer. For example, if the S material portion of the amphipathic copolymer is prepared from acrylate and/or methacrylate monomers (hereinafter, a "(meth)acrylate based moiety"), the soluble polymer is also preferably prepared from acrylate and/or methacrylate monomers (i.e. is also a (meth)acrylate based moiety). While not being bound by theory, it is believed that selection of the soluble polymer to be of the same general class of material as the S material portion of the amphipathic copolymer is particularly advantageous in providing a higher degree of compatibility between these components of the toner composition, thereby enhancing their interaction in solution. Optionally, the soluble polymer can in one embodiment be non-reactive in a polymerization (i.e. does not comprise a graft anchoring group) or in an alternative embodiment can be reactive in a polymerization reaction (i.e. comprises a graft anchoring group).

As noted above, it is particularly preferred that the soluble polymer and the S material portion of the amphipathic copolymer are sufficiently closely related as materials so as to have limited chemical variance and additionally limited molecular weight variance. By "% chemical variance" is meant that when comparing the monomer building blocks of the soluble polymer and the S material portion of the amphipathic copolymer in kind and amount (by relative ratio), the differences from the soluble polymer to the S material portion are less than the indicated percent variance. The evaluation of variance is based on that portion of the amphipathic copolymer that corresponds with the reactive chemistry of the soluble polymer. Thus, if the soluble polymer comprises a graft anchoring group, the evaluation of variance is based on the S material portion including the graft anchoring group. If the soluble polymer does not comprise a graft anchoring group, the evaluation of variance is based on the S material portion excluding the graft anchoring group. This evaluation technique is considered to be appropriate for the present invention because the soluble polymer is expected to associate with portions of the amphipathic copolymer that are like in chemical constitution.

The following specific examples of evaluation of chemical variance of soluble polymers and amphipathic copolymers in toner compositions are presented. First, it is determined whether the soluble polymer of the composition comprises functionality that is reactive in polymerization reactions used for the preparation of the corresponding amphipathic copolymer (i.e. whether it contains a graft anchoring group). If no functionality that would act as a graft anchoring group is present in the soluble polymer, an evaluation of the S material portion excluding the graft anchoring group is then carried out to determined the chemical constitution of this portion of the amphipathic copolymer. An example of the chemical constitution of a possible S portion of the amphipathic copolymer could constitute 97% 3,3,5-trimethylcyclohexylmethacrylate (TCHMA) and 3% 2-hydroxyethylmethacrylate (HEMA). In this example, a soluble polymer having a 20% weight ratio chemical constitution variance from this S portion would include polymers that comprise 77% TCHMA and 23% HEMA and also polymers that comprise 77% TCHMA, 20% t-butyl methacrylate (TBMA) and 3% HEMA. Note that the relative molecular weights of the soluble polymer and the S material portion of the amphipathic copolymer do not factor into the determination of % weight ratio chemical constitution variance.

In a preferred embodiment of the present invention, the soluble polymer has no more than about 30% weight ratio chemical constitution variance from the chemical constitution of the S material portion of the amphipathic copolymer. More preferably, the soluble polymer has no more than about 20% weight ratio chemical constitution variance, and most preferably no more than about 10% weight ratio chemical constitution variance from the chemical constitution of the S material portion of the amphipathic copolymer. In another embodiment of the present invention, the difference between the molecular weight of the soluble polymer and of the S material portion of the amphipathic copolymer is preferably no more than about 50%. More preferably, the difference between the molecular weight of the soluble polymer and of the S material portion of the amphipathic copolymer is no more than about 30%, and most preferably no more than about 10%. In particularly preferred embodiments, the soluble polymer and the S material portion of the amphipathic copolymer have no more than about a 30% weight ratio chemical constitution variance and no more than about a 50% molecular weight variance, more preferably no more than about a 20% weight ratio chemical constitution variance and no more than about a 30% molecular weight variance, and most preferably no more than about a 10% weight ratio chemical constitution variance and no more than about a 10% molecular weight variance.

It is specifically contemplated that the soluble polymer can comprise a reactive functionality that preferably is the same as the graft anchoring group of the S material portion of the amphipathic copolymer. When such a group is present in the soluble polymer, the chemical constitution variance and the molecular weight variance are calculated based on evaluation of the S material portion including the graft anchoring group. In a particularly preferred embodiment, the soluble polymer used is the starting material for the S material portion of the amphipathic copolymer, so that there is virtually no chemical constitution variance or molecular weight variance, and the graft anchoring group of the S material portion is a reactive functionality on the soluble polymer. This embodiment is particularly advantageous because the soluble polymer is highly compatible with the amphipathic copolymer, due to the identity with the S material portion. Additionally, this embodiment provides substantial manufacturing benefits because the soluble polymer is automatically provided as a starting material in the manufacturing process of the amphipathic copolymer. One may readily provide soluble polymer for incorporation into the toner composition by first preparing S material portion material, and reacting only part of that prepared S material portion material in the grafting reaction, followed by subsequent addition of additional unreacted S material portion material that functions as the soluble polymer. The use of the same S material portion as the soluble polymer provides unique efficiencies in reducing the number of diverse raw materials that must be utilized (providing inventory and quality control benefits), and reducing the number of reaction vessels that must utilized in the manufacturing process (providing energy, time, material and other resource benefits).

In another preferred embodiment, the soluble polymer does not comprise a graft anchoring group. As will be apparent in review of preferred manufacturing processes below, one may readily provide soluble polymer for incorporation into the toner composition by carrying out the preliminary reaction steps in preparation of the S material portion of the amphipathic copolymer, and withdrawing a desired quantity of the soluble polymer so prepared prior to introduction of the graft anchoring group to the S material portion material. The resulting soluble polymer is exceptionally closely related to the chemical constitution of the S material portion of the amphipathic copolymer, and therefore exhibits the compatibility benefits as discussed above. Further, manufacturing efficiencies are also realized, in reducing the number of diverse raw materials that must be utilized (providing inventory, quality control benefits), and reducing the number of reaction vessels that must utilized in the manufacturing process (providing energy, time, material and other resource benefits).

Particularly preferred soluble polymers are made from (meth)acrylate based moieties and comprise moieties selected from the group consisting of 3,3,5-trimethyl cyclohexyl methacrylate; t-butyl methacrylate; n-butyl methacrylate; isobornyl (meth)acrylate; 1,6-Hexanediol di(meth) acrylate; 2-hydroxyethyl methacrylate; dimethyl-m-isopropenyl benzyl isocyanate; and combinations thereof. In another embodiment, a particularly preferred soluble polymer is made from (meth)acrylate based moieties and comprises 3,3,5-trimethyl cyclohexyl methacrylate, 2-hydroxyethyl methacrylate and dimethyl-m-isopropenyl benzyl isocyanate.

In another embodiment of the present invention, particularly preferred soluble polymers are substantially free of reactive vinyl groups. Preferred examples of such polymers are made from (meth)acrylate based moieties and comprise moieties selected from the group consisting of trimethyl cyclohexyl methacrylate; t-butyl methacrylate; n-butyl methacrylate; isobornyl(meth)acrylate; 1,6-Hexanediol di(meth)acrylate; 2-hydroxyethyl methacrylate and combinations thereof. In another embodiment, a particularly preferred soluble polymer is made from (meth)acrylate based moieties and comprises trimethyl cyclohexyl methacrylate and 2-hydroxyethyl methacrylate. Another preferred embodiment is the soluble polymer that is a homopolymer made from trimethyl cyclohexyl methacrylate.

In preferred embodiments, the copolymer is polymerized in situ in the desired organic liquid carrier, as this yields substantially monodisperse copolymeric particles suitable for use in toner compositions. The resulting organosol is then preferably mixed with at least one visual enhancement additive and optionally one or more other desired ingredients to form a liquid toner. During such combination, ingredients comprising the visual enhancement particles and the copolymer will tend to self-assemble into composite particles having solvated (S) portions and dispersed (D) portions. Specifically, it is believed that the D material of the copolymer will tend to physically and/or chemically interact with the surface of the visual enhancement additive, while the S material helps promote dispersion in the carrier.

Preferably, the nonaqueous liquid carrier of the organosol is selected such that at least one portion (also referred to herein as the S material or shell portion) of the amphipathic copolymer is more solvated by the carrier while at least one other portion (also referred to herein as the D material or core portion) of the copolymer constitutes more of a dispersed phase in the carrier. In other words, preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier, forming dispersed particles.

From one perspective, the polymer particles when dispersed in the liquid carrier can be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material can also be referred to herein as a "graft stabilizer." The core/shell structure of the binder particles tends to be retained when the particles are dried when incorporated into liquid toner particles.

The solubility of a material, or a portion of a material such as a copolymeric portion, can be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H/RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters*, 2d Ed. CRC Press, Boca Raton, Fla., (1991), for monomers and representative polymers in *Polymer Handbook*, 3rd Ed., J. Brandrup & E. H. Immergut, Eds. John Wiley, N.Y., pp 519-557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier can be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier.

Consequently, in preferred embodiments, the absolute difference between the respective Hildebrand solubility parameters of the S material portion(s) of the copolymer and the liquid carrier is less than 3.0 $MPa^{1/2}$. In a preferred embodiment of the present invention, the absolute difference between the respective Hildebrand solubility parameters of the S material portion(s) of the copolymer and the liquid carrier is from about 2 to about 3.0 $MPa^{1/2}$. In a particularly preferred embodiment of the present invention, the absolute difference between the respective Hildebrand solubility parameters of the S material portion(s) of the copolymer and the liquid carrier is from about 2.5 to about 3.0 $MPa^{1/2}$. Additionally, it is also preferred that the absolute difference between the respective Hildebrand solubility parameters of the D material portion(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D material portion(s) is at least about 0.4 $MPa^{1/2}$, more preferably at least about 1.0 $MPa^{1/2}$. Because the solubility of a material can vary with changes in temperature, such solubility parameters are preferably determined at a desired reference temperature such as at 25° C.

Those skilled in the art understand that the Hildebrand solubility parameter for a copolymer, or portion thereof, can be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446-448. Thus, there will be a preferred molecular weight range for a given polymer or portion thereof in order to achieve desired solvating or dispersing characteristics. Similarly, the Hildebrand solubility parameter for a mixture can be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrographic toner and the Hildebrand solubility parameters and glass transition temperatures (based on their high molecular weight homopolymers) for some common monomers used in synthesizing organosols.

TABLE I

| Hildebrand Solubility Parameters Solvent Values at 25° C. | | |
|---|---|---|
| Solvent Name | Kauri-Butanol Number by ASTM Method D1133-54T (ml) | Hildebrand Solubility Parameter ($MPa^{1/2}$) |
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

| Monomer Values at 25° C. | | |
|---|---|---|
| Monomer Name | Hildebrand Solubility Parameter ($MPa^{1/2}$) | Glass Transition Temperature (° C.)* |
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (28 m.p.)** |
| n-Octadecyl Acrylate | 16.82 | −55 (42 m.p.)** |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Source: Calculated from equation #31 of Polymer Handbook, 3rd Ed., J. Brandrup E. H. Immergut, Eds. John Wiley, NY, p. VII/522 (1989). Calculated using Small's Group Contribution Method, Small, P. A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209-277 (1989). The $T_g$ listed is for the homopolymer of the respective monomer.
**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The substantially nonaqueous liquid carrier can be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred liquid carriers include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred liquid carriers have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization can be carried out in any appropriate solvent, and a solvent exchange can be carried out to provide the desired liquid carrier for the toner composition.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons.

The weight average molecular weight of the amphipathic copolymer of the present invention can vary over a wide range, and can impact imaging performance. The polydispersity of the copolymer also can impact imaging and transfer performance of the resultant liquid toner material. Because of the difficulty of measuring molecular weight for an amphipathic copolymer, the particle size of the dispersed copolymer (organosol) can instead be correlated to imaging and transfer performance of the resultant liquid toner material. Generally, the volume mean particle diameter ($D_v$) of the dispersed graft copolymer particles, determined by laser diffraction particle size measurement, should be in the range 1-100 microns, more preferably 5-75 microns, even more preferably 10-50 microns, and most preferably 20-30 microns.

In addition, a correlation exists between the molecular weight of the solvatable or soluble S material portion of the graft copolymer, and the imaging and transfer performance of the resultant toner. Generally, the S material portion of the copolymer has a weight average molecular weight in the range of 1000 to about 1,000,000 Daltons, preferably 5000 to 400,000 Daltons, more preferably 50,000 to 300,000 Daltons. It is also generally desirable to maintain the polydispersity (the ratio of the weight-average molecular weight to the number average molecular weight) of the S material portion of the copolymer below 15, more preferably below 5, most preferably below 2.5. It is a distinct advantage of the present invention that copolymer particles with such lower polydispersity characteristics for the S material portion are easily made in accordance with the practices described herein, particularly those embodiments in which the copolymer is formed in the liquid carrier in situ.

The relative amounts of S and D material portions in a copolymer can impact the solvating and dispersibility characteristics of these portions. For instance, if too little of the S material portion(s) are present, the copolymer can have too little stabilizing effect to sterically—stabilize the organosol with respect to aggregation as might be desired. If too little of the D material portion(s) are present, the small amount of D material can be too soluble in the liquid carrier such that there can be insufficient driving force to form a distinct particulate, dispersed phase in the liquid carrier. The presence of both a solvated and dispersed phase helps the ingredients of particles self assemble in situ with exceptional uniformity among separate particles. Balancing these concerns, the preferred weight ratio of D material to S material is in the range of 1/20 to 20/1, preferably 1/1 to 15/1, more preferably 2/1 to 10/1, and most preferably 4/1 to 8/1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54-55 (1992).

In the practice of the present invention, calculated values of $T_g$ for the D or S material portion of the copolymer or of the soluble polymer were determined using the Fox equation above, although the measured $T_g$ of the copolymer as a whole can be determined experimentally using e.g., differential scanning calorimetry. The glass transition temperatures ($T_g$'s) of the S and D material portions can vary over a wide range and can be independently selected to enhance manufacturability and/or performance of the resulting liquid toner particles. The $T_g$'s of the S and D material portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

For copolymers useful in liquid toner applications, the copolymer $T_g$ preferably should not be too low or else receptors printed with the toner can experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking, yet not so high as to require fusing temperatures approaching the temperatures at which the final image receptor can be damaged, e.g. approaching the autoignition temperature of paper used as the final image receptor. Desirably, therefore, the copolymer has a $T_g$ of 0°-100° C., more preferably 20°-90° C., most preferably 40°-80° C.

For copolymers in which the D material portion comprises a major portion of the copolymer, the $T_g$ of the D material portion will dominate the $T_g$ of the copolymer as a whole. For such copolymers useful in liquid toner applications, it is preferred that the $T_g$ of the D material portion fall in the range of 30°-105° C., more preferably 40°-95° C., most preferably 60°-85° C., since the S material portion will generally exhibit a lower $T_g$ than the D material portion, and a higher $T_g$ D material portion is therefore desirable to offset the $T_g$ lowering effect of the S material portion, which can be solvatable. Blocking with respect to the S material portion material is not as significant an issue inasmuch as preferred copolymers comprise a majority of the D material portion material. Consequently, the $T_g$ of the D material portion material will dominate the effective $T_g$ of the copolymer as a whole. However, if the $T_g$ of the S material portion is too low, then the particles might tend to aggregate. On the other hand, if the $T_g$ is too high, then the requisite fusing temperature can be too high. Balancing these concerns, the S material portion material is preferably formulated to have a $T_g$ of at least 0° C., preferably at least 20° C., more preferably at least 40° C. It is understood that the requirements imposed on the self-fixing characteristics of a liquid toner will depend to a great extent upon the nature of the imaging process. For example, rapid self-fixing of the toner to form a cohesive film may not be required or even desired in an electrographic imaging process if the image is not subsequently transferred to a final receptor, or if the transfer is effected by means (e.g. electrostatic transfer) not requiring a film formed toner on a temporary image receptor (e.g. a photoreceptor).

Similarly, in multi-color (or multi-pass) electrostatic printing wherein a stylus is used to generate a latent electrostatic image directly upon a dielectric receptor that serves as the final toner receptor material, a rapidly self-fixing toner film can be undesirably removed in passing under the stylus. This head scraping can be reduced or eliminated by manipulating the effective glass transition temperature of the organosol. For liquid electrographic (electrostatic) toners, particularly liquid toners developed for use in direct electrostatic printing processes, the D material portion of the organosol is preferably provided with a sufficiently high $T_g$ such that the organosol exhibits an effective glass transition temperature of from about 15° C. to about 55° C., and the D material portion exhibits a $T_g$ calculated using the Fox equation, of about 30-55° C.

In one aspect of the present invention, toner particles are provided that are particularly suitable for electrophotographic processes wherein the transfer of the image from the surface of a photoconductor to an intermediate transfer material or directly to a print medium is carried out without film formation on the photoconductor. In this aspect, the D material preferably has a $T_g$ of at least about 55° C., and more preferably at least about 65° C.

A wide variety of one or more different monomeric, oligomeric and/or polymeric materials can be independently incorporated into the S and D material portions, as desired. Representative examples of suitable materials include free radically polymerized material (also referred to as vinyl copolymers or (meth) acrylic copolymers in some embodiments), polyurethanes, polyester, epoxy, polyamide, polyimide, polysiloxane, fluoropolymer, polysulfone, combinations of these, and the like. Preferred S and D material portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case can be) that participate in polymerization reactions via a free radical mechanism. Representative examples of such functionality includes (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl", as used herein, encompasses acryl and/or methacryl.

Free radically polymerizable monomers, oligomers, and/or polymers are advantageously used to form the copolymer in that so many different types are commercially available and can be selected with a wide variety of desired characteristics that help provide one or more desired performance characteristics. Free radically polymerizable monomers, oligomers, and/or monomers suitable in the practice of the present invention can include one or more free radically polymerizable moieties.

Preferred monomers used to form the amphipathic copolymers and the soluble polymers as described herein are C1 to C24 alkyl esters of acrylic acid and methacrylic acid. Representative examples of monofunctional, free radically polymerizable monomers include styrene, alpha-methylstyrene, substituted styrene, vinyl esters, vinyl ethers, N-vinyl-2-pyrrolidone, (meth)acrylamide, vinyl naphthalene, alkylated vinyl naphthalenes, alkoxy vinyl naphthalenes, N-substituted (meth)acrylamide, octyl(meth)acrylate, nonylphenol ethoxylate(meth)acrylate, N-vinyl pyrrolidone, isononyl(meth)acrylate, isobornyl(meth)acrylate, 2-(2-ethoxyethoxy)ethyl(meth)acrylate, 2-ethylhexyl(meth)acrylate, beta-carboxyethyl(meth)acrylate, isobutyl(meth)acrylate, cycloaliphatic epoxide, alpha-epoxide, 2-hydroxyethyl (meth)acrylate, (meth)acrylonitrile, maleic anhydride, itaconic acid, isodecyl(meth)acrylate, lauryl(dodecyl)(meth) acrylate, stearyl(octadecyl)(meth)acrylate, behenyl(meth) acrylate, n-butyl(meth)acrylate, methyl(meth)acrylate, ethyl (meth)acrylate, hexyl(meth)acrylate, (meth)acrylic acid, N-vinylcaprolactam, stearyl(meth)acrylate, hydroxy functional caprolactone ester(meth)acrylate, isooctyl(meth)acrylate, hydroxyethyl(meth)acrylate, hydroxymethyl(meth) acrylate, hydroxypropyl(meth)acrylate, hydroxyisopropyl (meth)acrylate, hydroxybutyl(meth)acrylate, hydroxyisobutyl(meth)acrylate, tetrahydrofurfuryl(meth) acrylate, isobornyl(meth)acrylate, glycidyl(meth)acrylate vinyl acetate, combinations of these, and the like.

Preferred copolymers of the present invention can be formulated with one or more radiation curable monomers or combinations thereof that help the free radically polymerizable compositions and/or resultant cured compositions to satisfy one or more desirable performance criteria. For example, in order to promote hardness and abrasion resistance, a formulator can incorporate one or more free radically polymerizable monomer(s) (hereinafter "high $T_g$ component") whose presence causes the polymerized material, or a portion thereof, to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state. The advantages of incorporating such monomers into the copolymer are further described in assignee's co-pending U.S. patent application filed in the name of Qian et al., U.S. Ser. No. 10/612,765, filed on Jun. 30, 2003, entitled ORGANOSOL INCLUDING HIGH Tg AMPHIPATHIC COPOLYMERIC BINDER AND LIQUID TONER FOR ELECTROPHOTOGRAPHIC APPLICATIONS; and Qian et al., U.S. Ser. No. 10/612,533, filed on Jun. 30, 2003, entitled ORGANOSOL INCLUDING AMPHIPATHIC COPOLYMERIC BINDER MADE WITH SOLUBLE HIGH Tg MONOMER AND LIQUID TONERS FOR ELECTROPHOTOGRAPHIC APPLICATIONS for liquid toner compositions, which are hereby incorporated by reference.

In a preferred embodiment of the present invention, the S material portion, and preferably additionally the soluble polymer, comprises radiation curable monomers that have relatively high $T_g$ characteristics. Preferably, such monomers comprise at least one radiation curable (meth)acrylate moiety and at least one nonaromatic, alicyclic and/or nonaromatic heterocyclic moiety. Examples of preferred monomers that can be incorporated into the S material portion, and preferably additionally the soluble polymer, comprises isobornyl(meth)acrylate; 1,6-Hexanediol di(meth)acrylate; trimethyl cyclohexyl methacrylate; t-butyl methacrylate; and n-butyl methacrylate. Combinations of high $T_g$ components for use in both the S material portion and the soluble polymer are specifically contemplated, together with anchor grafting groups such as provided by use of HEMA subsequently reacted with TMI.

In certain preferred embodiments, polymerizable crystallizable compounds, e.g. crystalline monomer(s) are incorporated into the copolymer by chemical bonding to the copolymer. The term "crystalline monomer" refers to a monomer whose homopolymeric analog is capable of independently and reversibly crystallizing at or above room temperature (e.g., 22° C.). The term "chemical bonding" refers to a covalent bond or other chemical link between the polymerizable crystallizable compound and one or more of the other constituents of the copolymer. The advantages of incorporating PCC's into the copolymer are further described in assignee's co-pending U.S. patent application filed in the name of Qian et al., U.S. Ser. No. 10/612,534, filed on Jun. 30, 2003, entitled ORGANOSOL LIQUID TONER INCLUDING AMPHIPATHIC COPOLYMERIC BINDER HAVING CRYSTALLINE COMPONENT.

In these embodiments, the resulting toner particles can exhibit improved blocking resistance between printed receptors and reduced offset during fusing. If used, one or more of these crystalline monomers can be incorporated into the S and/or D material, but preferably is incorporated into the D material. Suitable crystalline monomers include alkyl (meth)acrylates where the alkyl chain contains more than 13 carbon atoms (e.g. tetradecyl(meth)acrylate, pentadecyl (meth)acrylate, hexadecyl(meth)acrylate, heptadecyl(meth) acrylate, octadecyl(meth)acrylate, etc). Other suitable crystalline monomers whose homopolymers have melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; polymerizable natural waxes with melting points above 22° C., polymerizable synthetic waxes with melting points above 22° C., and other similar type materials known to those skilled in the art. As described herein, incorporation of crystalline monomers in the copolymer provides surprising benefits to the resulting liquid toner particles.

Nitrile functionality can be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth)acrylonitrile, β-cyanoethyl-(meth)acrylate, 2-cyanoethoxyethyl(meth)acrylate, p-cyanostyrene, p-(cyanomethyl)styrene, N-vinylpyrrolidinone, and the like.

In order to provide a copolymer having pendant hydroxyl groups, one or more hydroxyl functional monomers can be used. Pendant hydroxyl groups of the copolymer not only facilitate dispersion and interaction with the pigments in the formulation, but also promote solubility, cure, reactivity with other reactants, and compatibility with other reactants. The hydroxyl groups can be primary, secondary, or tertiary, although primary and secondary hydroxyl groups are preferred. When used, hydroxy functional monomers constitute from about 0.5 to 30, more preferably 1 to about 25 weight percent of the monomers used to formulate the copolymer, subject to preferred weight ranges for graft copolymers noted below.

Representative examples of suitable hydroxyl functional monomers include an ester of an α, β-unsaturated carboxylic acid with a diol, e.g., 2-hydroxyethyl (meth)acrylate, or 2-hydroxypropyl(meth)acrylate; 1,3-dihydroxypropyl-2-(meth)acrylate; 2,3-dihydroxypropyl-1-(meth)acrylate; an adduct of an α, β-unsaturated carboxylic acid with caprolactone; an alkanol vinyl ether such as 2-hydroxyethyl vinyl ether; 4-vinylbenzyl alcohol; allyl alcohol; p-methylol styrene; or the like.

Multifunctional free radically reactive materials can also used to enhance one or more properties of the resultant toner particles, including crosslink density, hardness, tackiness, mar resistance, or the like. Examples of such higher functional, monomers include ethylene glycol di(meth)acrylate, hexanediol di(meth)acrylate, triethylene glycol di(meth) acrylate, tetraethylene glycol di(meth)acrylate, trimethylolpropane tri(meth)acrylate, ethoxylated trimethylolpropane tri(meth)acrylate, glycerol tri(meth)acrylate, pentaerythritol tri(meth)acrylate, pentaerythritol tetra(meth)acrylate, and neopentyl glycol di(meth)acrylate, divinyl benzene, combinations of these, and the like.

Suitable free radically reactive oligomer and/or polymeric materials for use in the present invention include, but are not limited to, (meth)acrylated urethanes (i.e., urethane (meth) acrylates), (meth)acrylated epoxies (i.e., epoxy(meth)acrylates), (meth)acrylated polyesters (i.e., polyester(meth)acrylates), (meth)acrylated(meth)acrylics, (meth)acrylated silicones, (meth)acrylated polyethers (i.e., polyether(meth) acrylates), vinyl(meth)acrylates, and(meth)acrylated oils.

Copolymers of the present invention can be prepared by free-radical polymerization methods known in the art, including but not limited to bulk, solution, and dispersion polymerization methods. The resultant copolymers can have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S material portion or D material portion materials, as the case can be, can be incorporated into the arms and/or the backbone.

Any number of reactions known to those skilled in the art can be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79-106, also incorporated herein by reference.

Representative examples of grafting methods also can use an anchoring group. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

The preferred methodology described above accomplishes grafting via attaching an ethylenically-unsaturated isocyanate (e.g., dimethyl-m-isopropenyl benzylisocyanate, TMI, available from CYTEC Industries, West Paterson, N.J.; or isocyanatoethyl methacrylate, IEM) to hydroxyl groups in order to provide free radically reactive anchoring groups.

A preferred method of forming a graft copolymer of the present invention involves three reaction steps that are carried out in a suitable substantially nonaqueous liquid carrier in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. metaisopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S material portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl(meth)acrylate, ethyl(meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially non-aqueous liquid carrier for the organosol. At this stage, it is believed that the copolymer tends to exist in the liquid carrier as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the liquid carrier. It can be appreciated that the copolymer is thus advantageously formed in the liquid carrier in situ.

Before further processing, the copolymer particles can remain in the reaction solvent. Alternatively, the particles can be transferred in any suitable way into fresh solvent that is the same or different so long as the copolymer has solvated and dispersed phases in the fresh solvent. In either case, the resulting organosol is then converted into toner particles by mixing the organosol with at least one visual enhancement additive. Optionally, one or more other desired ingredients also can be mixed into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier. In addition to the visual enhancement additive, other additives optionally can be formulated into the liquid toner composition.

Charge directors, can be used in any liquid toner process, and particularly can be used for electrostatic transfer of toner particles or transfer assist materials. The charge director typically provides the desired uniform charge polarity of the toner particles. In other words, the charge director acts to impart an electrical charge of selected polarity onto the toner particles as dispersed in the carrier liquid. Preferably, the charge director is coated on the outside of the binder particle. Alternatively or additionally, the charge director can be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

The preferred amount of charge director or charge control additive for a given toner formulation will depend upon a number of factors, including the composition of the polymer binder. Preferred polymeric binders are graft amphipathic copolymers. The preferred amount of charge director or charge control additive when using an organosol binder particle further depends on the composition of the S material portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge director or charge control additive will also depend upon the nature of the electrophotographic imaging process, particularly the design of the developing hardware and photoreceptive element. It is understood, however, that the level of charge director or charge control additive can be adjusted based on a variety of parameters to achieve the desired results for a particular application.

Any number of negative charge directors such as those described in the art can be used in the liquid toners of the present invention in order to impart a negative electrical charge onto the toner particles. For example, the charge director can be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt(e.g., Na) of a phosphoglyceride A preferred example of such a charge director is Emphos™ D70-30C, Witco Chemical Corp., New York. N.Y., which is a sodium salt of phosphated mono- and diglycerides.

Any number of positive charge directors such as those described in the art can be used in the liquid toners of the present invention in order to impart a positive electrical charge onto the toner particles. For example, the charge director can be introduced in the form of metal salts consisting of polyvalent metal ions and organic anions as the counterion. Suitable metal ions include Ba(II), Ca(II), Mn(II), Zn(II), Zr(IV), Cu(II), Al(III), Cr(III), Fe(II), Fe(III), Sb(III), Bi(III) Co(II), La(III), Pb(II), Mg(II), Mo(III), Ni(II), Ag(I), Sr(II), Sn(IV), V(V), Y(III) and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps), such as those described in U.S. Pat. No. 3,411,936. A particularly preferred positive charge director is zirconium 2-ethyl hexanoate.

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge directors matched to adsorption sites on the toner particles is a common practice to ensure sufficient charge associates with each toner particle.

Other additives can also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 1.5 to about 10 microns, most preferably in the range of about 3 to about 5 microns.

The toner compositions as described herein are highly useful in electrophotographic and electrographic processes.

In electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention can be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

While the electrostatic charge of either the toner particles or photoreceptive element can be either positive or negative, electrophotography as employed in the present invention is preferably carried out by dissipating charge on a positively charged photoreceptive element. A positively-charged toner is then applied to the regions in which the positive charge was dissipated using a liquid toner development technique.

The substrate for receiving the image from the photoreceptive element can be any commonly used receptor material, such as paper, coated paper, polymeric films and primed or coated polymeric films. Polymeric films include polyesters and coated polyesters, polyolefins such as polyethylene or polypropylene, plasticized and compounded polyvinyl chloride (PVC), acrylics, polyurethanes, polyethylene/acrylic acid copolymer, and polyvinyl butyrals. The polymer film can be coated or primed, e.g. to promote toner adhesion.

In electrophotographic processes, the toner composition preferably is provided at a solids content of about 1-30% (w/w). In electrostatic processes, the toner composition preferably is provided at a solids content of 3-15% (w/w).

These and other aspects of the present invention are demonstrated in the illustrative examples that follow.

EXAMPLES

A. Test Methods and Apparatus

Percent Solids

In the following toner composition examples, percent solids of the graft stabilizer solutions and the organosol and liquid toner dispersions were determined thermo-gravimetrically by drying in an aluminum weighing pan an originally-weighed sample at 160° C. for two hours for graft stabilizer, three hours for organosol, and two hours for liquid toner dispersions, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Molecular Weight

In the practice of the invention, molecular weight is normally expressed in terms of the weight average molecular weight, while molecular weight polydispersity is given by the ratio of the weight average molecular weight to the number average molecular weight. Molecular weight parameters were determined with gel permeation chromatography (GPC) using a Hewlett Packard Series II 1190 Liquid Chromatograph made by Agilent Industries (formerly Hewlett Packard, Palo Alto, Calif.) (using software HPLC Chemstation Rev A.02.02 1991-1993 395). Tetrahydrofuran was used as the carrier solvent. The three columns used in the Liquid Chromatograph were Jordi Gel Columns (DVB 1000A, and DVB10000A and DVB100000A; Jordi Associates, Inc., Bellingham, Mass.). Absolute weight average molecular weight were determined using a Dawn DSP-F light scattering detector (software by Astra v.4.73.04 1994-1999) (Wyatt Technology Corp., Santa Barbara, Calif.), while polydispersity was evaluated by ratioing the measured weight average molecular weight to a value of number average molecular weight determined with an Optilab DSP Interferometric refractometer detector (Wyatt Technology Corp., Santa Barbara, Calif.).

Particle Size

The organosol (and liquid ink) particle size distributions were determined using a Horiba LA-920 laser diffraction particle size analyzer (commercially obtained from Horiba Instruments, Inc, Irvine, Calif.) using Norpar™ 12 fluid that contains 0.1% (w/w) Aerosol OT (dioctyl sodium sulfosuccinate, sodium salt, Fisher Scientific, Fairlawn, N.J.) surfactant.

Prior to the measurements, samples were pre-diluted to approximately 1% (w/w) by the solvent (i.e., Norpar™ 12 or water). Liquid toner samples are were sonicated for 6 minutes in a Probe VirSonic sonicator (Model-550 by The VirTis Company, Inc., Gardiner, N.Y.). The samples were diluted by approximately 1/500 by volume prior to sonication. Sonication on the Horiba LA-920 was operated at 150 watts and 20 kHz. The particle size was expressed on a number-average basis in order to provide an indication of dominance of the fundamental (primary) particle size of the particles or was expressed on a volume-average basis in order to provide an indication of dominance of the coalesced primary particle aggregate size of the particles.

Glass Transition Temperature ($T_g$)

Glass transition temperatures of the polymer samples were measured by using a Differential Scanning Calorimeter (TA Instruments Model 2929, New Castle, Del.) equipped with a DSC refrigerated cooling system (−60° C. minimum temperature limit), and dry helium and nitrogen exchange gases. The calorimeter ran on a Thermal Analyst 2100 workstation with version 8.10B software. An empty aluminium pan was used as the reference. Each sample was evaluated using 10° C./min heating and cooling rates with a 5-10 min isothermal bath at the end of each heating or cooling ramp.

The organosol sample for DSC measurement was prepared by drying the polymer on an aluminum weighing pan in an oven at 160° C. for 3 hours. The dried polymer was then placed in a DSC aluminum sample pan and sealed. During the DSC measurements, each sample was equilibrated at 0° C. and then heated to at least 30° C. above its $T_g$ followed by cooling to least 30° C. below its $T_g$. This heating/cooling cycle was repeated five times. $T_g$ was taken from either the $4^{th}$ or the $5^{th}$ heating cycle.

Conductivity

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 10° C. for 1 hour at 7,500 rpm (6,110 relative centrifugal force) in a Jouan MR1822 centrifuge (Winchester, Va.). The supernatant liquid was then carefully decanted, and the conductivity of this liquid ($k_f$) was measured using a Scientifica Model 627 conductance meter. The percentage of free phase conductivity relative to the bulk toner conductivity was then determined as 100% ($k_f/k_b$).

Mobility

Toner particle electrophoretic mobility (dynamic mobility) was measured using a Matec MBS-8000 Electrokinetic Sonic Amplitude Analyzer (Matec Applied Sciences, Inc., Hopkinton, Mass.). Unlike electrokinetic measurements based upon microelectro-phoresis, the MBS-8000 instrument has the advantage of requiring no dilution of the toner sample in order to obtain the mobility value. Thus, it was possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counter-ions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant.

Charge Per Mass

The charge per mass measurement (Q/m) was measured using an apparatus that consists of a conductive metal plate, a glass plate coated with Indium Tin Oxide (ITO), a high voltage power supply, an electrometer, and a personal computer (PC) for data acquisition. A 1% solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times per second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles can be made to migrate to that plate.

The ITO coated glass plate was removed from the apparatus and placed in an oven for approximately 1 hour at 160° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

Print Testing

In the following examples, toner was printed onto final image receptors using the following methodology:

A light-sensitive temporary image receptor (organic photoreceptor or "OPC") was charged with a uniform positive charge of approximately 850 volts. The positively charged surface of the OPC was image-wise irradiated with a scanning infrared laser module in order to reduce the charge wherever the laser struck the surface. Typical charge-reduced values were between 50 volts and 100 volts.

A developer apparatus was then utilized to apply the toner particles to the OPC surface. The developer apparatus included the following elements: liquid toner, a conductive rubber developer roller in contact with the OPC, an insulative foam cleaning roller in contact with the developer roller surface, a conductive deposition roller, a conductive metering roll in contact with the developer roller, and an insulative foam ink pumping roller. The contact area between the developer roller and the OPC is referred to as the "developing nip." The conductive deposition roller was positioned with its roller axis parallel to the developer roller axis and its surface arranged to be approximately 150 microns from the surface of the developer roller, thereby forming a deposition gap.

During development, the ink pumping roller supplied liquid ink to the gap between the deposition roller and the developer roller. A toner film was initially plated to the developer roller surface by applying a voltage of approximately 600 volts to the developer roller and applying a voltage of approximately 800 volts to both the deposition and metering rollers. The 200 volt difference between the developer and deposition roller caused the positively charged toner particles to migrate in the deposition nip to the surface of the developer roller. The metering roller, which is biased to approximately 800 volts, removed excess liquid from the developer roller surface.

The surface of the developer roller now contained a uniformly thick layer of toner at approximately 25% (w/w) solids. As this toner layer passed through the developing nip, toner was transferred from the developer roller to the latent image areas. The approximate 500 volt difference between the developer roller and the latent image area caused the positively charged toner particles to develop to the OPC surface. At the exit of the developing nip, the OPC contained a toner image and the developer roller contained a negative of that toner image which was then cleaned from the developer roller surface by the rotating foam cleaning roller.

The developed image on the OPC was subsequently electrostatically transferred to an Intermediate Transfer Belt (ITB) with an electrical bias in the range of −800 to −2000 volts applied to a conductive rubber roller pressing the ITB to the OPC surface. Transfer to the final image receptor was accomplished with electrostatically-assisted offset transfer by forcibly applying a conductive, biased rubber transfer roller behind the image receptor, pressing the imaged ITB between the final image receptor and a grounded, conductive metal transfer backup roller. The transfer roller is typically biased in the range of −1200 to −3000 volts.

Optical Density

To measure optical density and color purity a GRETAG SPM 50 LT meter was used. The meter is made by Gretag Limited, CH-8105 Regensdort, Switzerland. The meter has several different functions through different modes of operations, selected through different buttons and switches. When a function (optical density, for example) is selected, the measuring orifice of the meter is placed on the designated color patch and the measurement button is activated. The optical densities of the various color components of the color patch (in this case, Cyan (C), Magenta (M), Yellow (Y), and Black (K)) are then displayed on the screen of the meter. The value of each specific component is then used as the optical density for that component of the color patch. For instance, where a color patch is only cyan, the optical density reading can be listed as simply the value on the screen for C. Where the color patch is a combination of colors (such as Blue=Cyan+Magenta), the meter will read the optical density of the cyan that contributes to the blue patch and is expressed as C(B); that same patch would also have a magenta component, expressed as M(B).

Aging

Accelerated aging is performed in an oven set at 55° C. Approximately 70 g of the ink samples are place in a 4 ounce jars. The jars are capped and firmly sealed. To insure no carrier loose, the caps are then taped with vinyl tape (3M Brand Electrical Tape) to seal. Samples are placed in the oven and left undisturbed for 1 week increments. At on week the samples are removed from the oven and allowed to cool to ambient temperature for two hours. At two hours, the tape and jar lid are removed, samples are visually evaluated for settling by inserting a metal spatula to the bottom of the jar and pulling the spatula through the contents. Visual observations are recorded using the following criteria.

| Rating | Observation | Description |
|---|---|---|
| 1 | Liquid | No visible change |
| 2 | Soft Gel | Spatula makes an indentation that fills up with ink immediately |
| 3 | Gel | Spatula makes an indentation that slowly fills with ink once it is removed |

-continued

| Rating | Observation | Description |
|---|---|---|
| 4 | Soft Paste | Spatula makes an indentation-ink is very slow to ooze back into the void |
| 5 | Paste | Spatula makes an indentation-sides of the indentation are soft and hold their shape for a limited time |
| 6 | Hard paste | Spatula encounters resistance-the sides of the indentation are rigid and do not readily fill in the void |

Next, the samples are mixed with the spatula to redisperse them and then re-evaluated using the above scale. The jars are then recapped and sealed using fresh tape and placed back in oven. This test is performed weekly for three weeks. After three weeks, the 55° C. aging samples are allowed to sit at room temperature for two weeks, then the viscosity of each sample is measured using a Brookfield LV Viscometer (available from Brookfield Inc., Middleboro, Mass.).

B. Materials

The following abbreviations are used in the examples:

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

TCHMA: 3,3,5-trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

V-601: Dimethyl 2,2'-azobisisobutyrate (an initiator available as V-601 from WAKO Chemicals U.S.A., Richmond, Va.)

DBTDL: Dibutyl tin dilaurate (a catalyst available from Aldrich Chemical Co., Milwaukee, Wis.)

C. Nomenclature

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case can be. For example, a graft stabilizer (precursor to the S material portion of the copolymer) is designated TCHMA/HEMA-TMI (97/3-4.7% (w/w)), and is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97-3-4.7//100% (w/w)) is made by copolymerizing the designated graft stabilizer (TCHMA/HEMA-TMI (97/3-4.7% w/w)) (S material portion or shell) with the designated core monomer EMA (D material portion or core) at a specified ratio of D/S (core/shell) determined by the relative weights reported in the examples.

S material portion (or "shell material") that has not had the graft anchor group (e.g., TMI) incorporated into the polymeric material will be designated Soluble Polymer-P herein. An example of the nomenclature designation for such a polymer is TCHMA/HEMA (97/3). S material portion comprising the graft anchor group (e.g., TMI) incorporated into the polymeric material that is added to the toner composition as the soluble polymer will be designated Soluble Polymer-S, or graft stabilizer, herein.

D. Preparation of Copolymer Graft S Material Portion/Soluble Polymer-S and Soluble Polymer-P

TABLE 1

| Graft Stabilizers/Soluble Polymer | | | | |
|---|---|---|---|---|
| Example Number | Graft Stabilizer Compositions (% w/w) | Solids (wt %) | Molecular Weight $M_w$ | $M_w/M_n$ |
| 1 | TCHMA/HEMA-TMI (97/3-4.7% w/w) | 25.4% | 299,100 | 2.6 |
| 2 | TCHMA/HEMA-TMI (97/3-4.7% w/w) | 26.0% | 286,900 | 2.58 |
| 3 | TCHMA/HEMA-TMI (97/3-4.7% w/w) | 26.6% | 251,300 | 2.8 |
| 4 | TCHMA/HEMA (97/3% w/w) | 26.6% | 255,600 | 2.6 |

Example 1

A 50 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 195 lbs of Norpar™ 12, by vacuum. The vacuum was then broken and a flow of 1 CFH (cubic foot per hour) of nitrogen applied and the agitation is started at 70 RPM. 66.4 lbs of TCHMA was added and the container rinsed with 2.7 lbs of Norpar™ 12. 2.10 lbs of 98% (w/w) HEMA was added and the container rinsed with 1.37 lbs of Norpar™ 12. Finally 0.86 lb of V-601 was added and the container rinsed with 0.2 lb of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 70 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.11 lb of 95% (w/w) DBTDL was added to the mixture using 1.37 lbs of Norpar™ 12 to rinse container, followed by 3.23 lbs of TMI. The TMI was added drop wise over the course of approximately 5 minutes while stirring the reaction mixture and the container was rinsed with 1.4 lbs of Norpar™ 12. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 25.4% (w/w) using the thermogravimetric method described above. Subsequent determination of molecular weight was made using the GPC method described above; the copolymer had a $M_w$ of 299, 100 and $M_w/M_n$ of 2.622 based on two independent measurements. The product is a copolymer of TCHMA and HEMA containing random side chains of TMI and is designated herein as TCHMA/HEMA-TMI (97/3-4.7% w/w) and can be used to make an organosol.

Example 2

A 50 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 195 lbs of Norpar™ 12, by vacuum. The vacuum was then broken and a flow of 1 CFH (cubic foot per hour) of nitrogen applied and the agitation is started at 70 RPM. 66.4 lbs of TCHMA was added and the container rinsed with 2.7 lbs of Norpar™ 12. 2.10 lbs of 98% (w/w) HEMA was added and the container rinsed with 1.37 lbs of Norpar™ 12. Finally 0.86 lb of V-601 was added and the container rinsed with 0.2 lb of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 75 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.11 lb of 95% (w/w) DBTDL was added to the mixture using 1.37 lbs of Norpar™ 12 to rinse container, followed by 3.23 lbs of TMI. The TMI was added drop wise over the course of approximately 5 minutes while stirring the reaction mixture and the container was rinsed with 1.4 lbs of Norpar™ 12. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.0% (w/w) using the thermogravimetric method described above. Subsequent determination of molecular weight was made using the GPC method described above; the copolymer had a $M_w$ of 286, 900 and $M_w/M_n$ of 2.58 based on two independent measurements. The product is a copolymer of TCHMA and HEMA containing random side chains of TMI and is designated herein as TCHMA/HEMA-TMI (97/3-4.7% w/w) and can be used to make an organosol.

Example 3

A 50 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 195 lbs of Norpar™ 12, by vacuum. The vacuum was then broken and a flow of 1 CFH (cubic foot per hour) of nitrogen applied and the agitation is started at 70 RPM. 66.4 lbs of TCHMA was added and the container rinsed with 2.7 lbs of Norpar™

12. 2.10 lbs of 98% (w/w) HEMA was added and the container rinsed with 1.37 lbs of Norpar™ 12. Finally 0.86 lb of V-601 was added and the container rinsed with 0.2 lb of Norpar™ 12. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 1 CFH was applied. Agitation was resumed at 70 RPM and the mixture was heated to 75° C. and held for 4 hours. The conversion was quantitative.

The mixture was heated to 100° C. and held at that temperature for 1 hour to destroy any residual V-601, and then was cooled back to 70° C. The nitrogen inlet tube was then removed, and 0.11 lb of 95% (w/w) DBTDL was added to the mixture using 1.37 lbs of Norpar™ 12 to rinse container, followed by 3.23 lbs of TMI. The TMI was added drop wise over the course of approximately 5 minutes while stirring the reaction mixture and the container was rinsed with 1.4 lbs of Norpar™ 12. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 26.6% (w/w) using the thermogravimetric method described above. Subsequent determination of molecular weight was made using the GPC method described above; the copolymer had a $M_w$ of 251, 300 and $M_w/M_n$ of 2.8 based on two independent measurements. The product is a copolymer of TCHMA and HEMA containing random side chains of TMI and is designated herein as TCHMA/HEMA-TMI (97/3-4.7% w/w) and can be used to make an organosol.

E. Preparation of Soluble Polymer-P (Without Graft Anchoring Group)

Example 4

A 5000 ml, 3-neck round flask equipped with a condenser, a thermocouple connected to a digital temperature controller, a nitrogen inlet tube connected to a source of dry nitrogen and a magnetic stirrer, was charged with a mixture of 2573 g of Norpar™ 12 fluid, 849 g of TCHMA, 26.8 g of 98% (w/w) HEMA and 8.75 g of V-601. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liter/minute. The mixture was heated to 75° C. for 4 hours. The conversion was quantitative.

The mixture was then heated to 100° C., held at that temperature for 1 hour to destroy any residual V-601, and then cooled to room temperature.

The cooled mixture was a viscous, transparent liquid containing no visible insoluble matter. The percent solids of the liquid mixture were determined to be 26.6% (w/w) using the thermogravimetric method described above. Subsequent determination of molecular weight was made using the GPC method described above; the copolymer had a $M_w$ of 255, 600 and $M_w/M_n$ of 2.6 based on two independent measurements. The product is a copolymer of TCHMA and HEMA and is designated herein as TCHMA/HEMA (97/3% w/w).

F. Preparations of Organosols

TABLE 2

Organosols

| Example Number | Organosol Compositions (% w/w) | D/S ratio |
|---|---|---|
| 5 | TCHMA/HEMA-TMI//EMA (97/3-4.7//100% w/w) | 8 |
| 6 | TCHMA/HEMA-TMI//EMA (97/3-4.7//100% w/w). | 6 |
| 7 | TCHMA/HEMA-TMI//EMA (97/3-4.7//100% w/w) | 8 |

Example 5

This is an example of an organosol that has a D/S ratio of 8/1. A 560 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 1520 lbs of Norpar™ 12 and 94.9 lbs of the graft stabilizer mixture from Example 1 @ 25.4% (w/w) polymer solids along with an additional 9.5 lbs of Norpar™ 12 to rinse the pump. Agitation was then turned on at a rate of 65 RPM, and temperature was check to ensure maintenance at ambient. Next 203 lbs of EMA was added along with 57 lbs Norpar™ 12 for rinsing the pump. Finally 2.28 lbs of V-601 was added, along with 9.5 lbs of Norpar™ 12 to rinse the container. A vacuum was then applied at 40 torr for 10 minutes, and then broken by a nitrogen blanket. A second vacuum was pulled at 40 torr for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 75 RPM was resumed and the temperature of the reactor was heated to 75° C. and maintained for 5 hours. The conversion was quantitative.

The resulting mixture was stripped of residual monomer by adding 190 lbs of n-heptane and 380 lbs of Norpar™ 12 and agitation was held at 80 RPM with the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 795 lbs of distillate was collected. A second strip was performed, following the above procedure. 621 lbs of distillate were collected. The vacuum was then broken, and the stripped organosol was cooled to room temperature, yielding an opaque white dispersion.

This organosol is designated TCHMA/HEMA-TMI//EMA (97/3-4.7//100% w/w). The percent solid of the organosol dispersion after stripping was determined as approximately 12.5% (w/w) by the thermogravimetric method described above. Subsequent determination of average particles size was made using the light scattering method described above; the organosol had a volume average diameter of 42.3 μm. The glass transition temperature was measured using DSC, as described above. The organosol polymer had a measured $T_g$ of 62.7° C.

Example 6

This is an example of an organosol that has a D/S ratio of 6/1. A 560 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 1528 lbs of Norpar™ 12 and 128.2 lbs of the graft stabilizer mixture from Example 1 @ 25.4% (w/w) polymer solids along with an additional 9.5 lbs of Norpar™ 12 to rinse the pump. Agitation was then turned on at a rate of 65 RPM, and temperature was check to ensure maintenance at ambient. Next 196 lbs of EMA was added along with 28.5 lbs Norpar™ 12 for rinsing the pump. Finally 2.28 lbs of V-601 was added, along with 9.5 lbs of Norpar™ 12 to rinse the container. A vacuum was then applied at 40 torr for 10 minutes, and then broken by a nitrogen blanket. A second vacuum was pulled at 40 torr for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 75 RPM was resumed and the temperature of the reactor was heated to 75° C. and maintained for 5 hours. The conversion was quantitative.

The resulting mixture was stripped of residual monomer by adding 190 lbs of n-heptane and 380 lbs of Norpar™ 12 and agitation was held at 80 RPM with the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 839 lbs of distillate was collected. A second strip was performed, following the above procedure. 606 lbs of distillate were collected. The vacuum was then broken, and the stripped organosol was cooled to room temperature, yielding an opaque white dispersion.

This organosol is designated TCHMA/HEMA-TMI//EMA (97/3-4.7//100% w/w). The percent solid of the organosol dispersion after stripping was determined as approximately 13% (w/w) by the thermogravimetric method described above. Subsequent determination of average particles size was made using the light scattering method described above; the organosol had a volume average diameter of 43.6 μm. The glass transition temperature was measured using DSC, as described above. The organosol polymer had a measured $T_g$ of 75.29° C.

Example 7

This is an example of an organosol that has a D/S ratio of 8/1. A 560 gallon reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 1520 lbs of Norpar™ 12 and 97.5 lbs of the graft stabilizer mixture from Example 2 @ 26.0% (w/w) polymer solids along with an additional 9.5 lbs of Norpar™ 12 to rinse the pump. Agitation was then turned on at a rate of 65 RPM, and temperature was check to ensure maintenance at ambient. Next 203 lbs of EMA was added along with 57 lbs Norpar™ 12 for rinsing the pump. Finally 2.28 lbs of V-601 was added, along with 9.5 lbs of Norpar™ 12 to rinse the container. A vacuum was then applied at 40 torr for 10 minutes, and then broken by a nitrogen blanket. A second vacuum was pulled at 40 torr for 10 minutes, and then agitation stopped to verify that no bubbles were coming out of the solution. The vacuum was then broken with a nitrogen blanket and a light flow of nitrogen of 0.5 CFH (cubic foot per hour) was applied. Agitation of 75 RPM was resumed and the temperature of the reactor was heated to 75° C. and maintained for 5 hours. The conversion was quantitative.

The resulting mixture was stripped of residual monomer by adding 190 lbs of n-heptane and 380 lbs of Norpar™ 12 and agitation was held at 80 RPM with the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 847 lbs of distillate was collected. A second strip was performed, following the above procedure. 624 lbs of distillate were collected. The vacuum was then broken, and the stripped organosol was cooled to room temperature, yielding an opaque white dispersion.

This organosol is designated TCHMA/HEMA-TMI//EMA (97/3-4.7//100% w/w). The percent solid of the organosol dispersion after stripping was determined as approximately 13% (w/w) by the thermogravimetric method described above. Subsequent determination of average particles size was made using the light scattering method described above; the organosol had a volume average diameter of 32.4 μm. The glass transition temperature was measured using DSC, as described above. The organosol polymer had a measured $T_g$ of 69.11° C.

G. Preparation of Liquid Inks

Comparative Example 8-Yellow 12548 g of the above organosol from example 5@ approximately 12.5% (w/w) solids in Norpar™ 12 was combined with 2060 g of Norpar™ 12,292.5 g of Pigment Yellow 138 (available from BASF Corp., Charlotte, N.C.), 32.5 g of Pigment Yellow 83 (Sun Chemical Company, Cincinnati, Ohio) and 67.07 g of 26.65% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4175 g of 0.8 mm diameter Yttrium Stabilized Ceramic Media (available from Morimura Bros. (USA), Inc., Torrence, Calif.). The mill was operated at 2,500 RPM for 60 minutes with water circulating through the jacket of the milling chamber at 80° C. The mill was then cooled to 45° C. and milled an additional 85 minutes.

A 14.02% (w/w) solids toner concentrate exhibited the following properties as determined using the test methods described above:

Volume Mean Particle Size: 2.81 μm

Q/M: 160 μC/g

Bulk Conductivity: 150 picoMhos/cm

Percent Free Phase Conductivity: 7.60%

Dynamic Mobility: 4.46E-11 ($m^2$/Vsec)

Comparative Example 9-Cyan 12,759 g of the above organosol from example 5@ approximately 12.5% (w/w) solids in Norpar™ 12 was combined with 1947 g of Norpar™ 12,292.5 g of Pigment Blue 15:2 (PB:15:2, D83071, Sun Chemical Company, Cincinnati, Ohio) and 14.98 g of 27.90% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4,175 g of 0.8 mm diameter Yttrium Stabilized Ceramic Media (available from Morimura Bros. (USA), Inc., Torrence, Calif.). The mill was operated at 2,500 RPM for 60 minutes with water circulating through the jacket of the milling chamber at 80° C. The mill was then cooled to 45° C. and the mixture milled an additional 30 minutes.

A 13.52% (w/w) solids toner concentrate exhibited the following properties as determined using the test methods described above:

Volume Mean Particle Size: 2.75 μm

Q/M: 145 μC/g

Bulk Conductivity: 237 picoMhos/cm

Percent Free Phase Conductivity: 1.03%

Dynamic Mobility: 6.91E-11 ($m^2$/Vsec)

Comparative Example 10-Magenta 13,025 g of the organosol from example 5@ approximately 12.5% (w/w) solids in Norpar™ 12 was combined with 1,677 g of Norpar™ 12,146.4 g Pigment Red 146 (Symuler Fast Red 4580, available from Dainippon Ink and Chemicals Inc., Tokyo, Japan), 48.8 g of Pigment RA1087 (Magruder Color Co., Elizabeth, N.J.) 48.8 g of RH0205 (Magruder Color Co., Elizabeth, N.J.), and 54.88 g of 26.65% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4,175 g of 0.8 mm diameter Yttrium Stabilized Ceramic Media (available from Morimura Bros. (USA), Inc., Torrence, Calif.). The mill was operated at 2,500 RPM for 90 minutes with water circulating through the jacket of the milling chamber at 45° C.

A 13.59% (w/w) solids toner concentrate exhibited the following properties as determined using the test methods described above:

Volume Mean Particle Size: 2.58 μm

Q/M: 328 μC/g

Bulk Conductivity: 357 picoMhos/cm

Percent Free Phase Conductivity: 2.06%

Dynamic Mobility: 7.15 E-11 ($m^2$/Vsec)

Comparative Example 11-Black 12,759 g of the organosol from example 5@ approximately 12.5% (w/w) solids in Norpar™ 12 was combined with 1,932 g of Norpar™ 12,279 g Pigment Black EK8200 (Aztech Company, Tucson), and 29.95 g of 27.9% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4175 g of 0.8 mm diameter Yttrium Stabilized Ceramic Media (available from Morimura Bros. (USA), Inc., Torrence, Calif.). The mill was operated at 2500 RPM for 60 minutes with water circulating through the jacket of the milling chamber at 80° C. The mill was then cooled to 45° C. and the mixture milled an additional 30 minutes.

A 13.64% (w/w) solids toner concentrate exhibited the following properties as determined using the test methods described above:

Volume Mean Particle Size: 5.28 μm

Q/M: 159 μC/g

Bulk Conductivity: 317 picoMhos/cm

Percent Free Phase Conductivity: 2.80%

Dynamic Mobility: 2.22E-11 ($m^2$/Vsec)

Comparative Example 12-Yellow 12,218 g of the above organosol from example 6@ approximately 13.0% (w/w) solids in Norpar™ 12 was combined with 2390 g of Norpar™ 12,292.5 g of Pigment Yellow 138 (available from BASF Corp., Charlotte, N.C.), 32.5 g of Pigment Yellow 83 (Sun Chemical Company, Cincinnati, Ohio) and 67.07 g of 26.65% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4175 g of 0.8 mm diameter Yttrium Stabilized Ceramic Media (available from Morimura Bros. (USA), Inc., Torrence, CA). The mill was operated at 2,500 RPM for 60 minutes with water circulating through the jacket of the milling chamber at 80° C. The mill was then cooled to 45° C. and milled an additional 80 minutes.

A 13.80% (w/w) solids toner concentrate exhibited the following properties as determined using the test methods described above:

Volume Mean Particle Size: 2.86 μm

Q/M: 212 μC/g

Bulk Conductivity: 187 picoMhos/cm

Percent Free Phase Conductivity: 6.23%

Dynamic Mobility: 4.91 E-11 ($m^2$/Vsec)

Comparative Example 13-Cyan 12,567 g of the above organosol from example 6@ approximately 13.0% (w/w) solids in Norpar™ 12 was combined with 2,139 g of Norpar™ 12,279 g of Pigment Blue 15:2 (PB:15:2, D83071, Sun Chemical Company, Cincinnati, Ohio) and 14.98 g of 27.90% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4,175 g of 0.8 mm diameter Yttrium Stabilized Ceramic Media (available from Morimura Bros. (USA), Inc., Torrence, Calif.). The mill was operated at 2,500 RPM for 30 minutes with water circulating through the jacket of the milling chamber at 80° C. The mill was then cooled to 45° C. and milled an additional 35 minutes.

A 13.54% (w/w) solids toner concentrate exhibited the following properties as determined using the test methods described above:

Volume Mean Particle Size: 3.4062 μm

Q/M: 207 μC/g

Bulk Conductivity: 335 picoMhos/cm

Percent Free Phase Conductivity: 1.76%

Dynamic Mobility: 6.72E-11 ($m^2$/Vsec)

Comparative Example 14-Magenta 13,025 g of the organosol from example 6@ approximately 13.0% (w/w) solids in Norpar™ 12 was combined with 1,888 g of Norpar™ 12,244 g of RH0205 (Magruder Color Co., Elizabeth, N.J.), and 39.31 g of 27.90% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4175 g of 0.8 mm diameter Yttrium Stabilized Ceramic Media (available from Morimura Bros. (USA), Inc., Torrence, Calif.). The mill was operated at 2500 RPM for 60 minutes with water circulating through the jacket of the milling chamber at 80° C. The mill was then cooled to 45° C. and milled an additional 45 minutes.

A 13.59% (w/w) solids toner concentrate exhibited the following properties as determined using the test methods described above:

Volume Mean Particle Size: 2.58 μm
Q/M: 330 μC/g
Bulk Conductivity: 288 picoMhos/cm
Percent Free Phase Conductivity: 3.27% Dynamic Mobility: 6.82E-11 ($m^2$/Vsec)

Comparative Example 15-Black 12,567 g of the organosol from example 6@ approximately 13% (w/w) solids in Norpar™ 12 was combined with 2124 g of Norpar™ 12,279 g Pigment Black EK8200 (Aztech Company, Tucson), and 29.95 g of 27.9% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4175 g of 0.8 mm diameter Yttrium Stabilized Ceramic Media (available from Morimura Bros. (USA), Inc., Torrence, CA). The mill was operated at 2500 RPM for 60 minutes with water circulating through the jacket of the milling chamber at 80° C. The mill was then cooled to 45° C. and the mixture milled an additional 35 minutes.

A 12.94% (w/w) solids toner concentrate exhibited the following properties as determined using the test methods described above:

Volume Mean Particle Size: 2.76 μm
Q/M: 203 μC/g
Bulk Conductivity: 266 picoMhos/cm
Percent Free Phase Conductivity: 2.92%
Dynamic Mobility: 7.74E-11 ($m^2$/Vsec)

Comparative Example 16-Black 12,567 g of the organosol from example 7@ approximately 13.3% (w/w) solids in Norpar™ 12 was combined with 2,110 g of Norpar™ 12,278.6 g Pigment Black EK8200 (Aztech Company, Tucson), and 43.7 g of 25.5% (w/w) Zirconium HEX-CEM solution (OMG Chemical Company, Cleveland, Ohio). This mixture was then milled in a Hockmeyer HSD Immersion Mill (Model HM1, Hockmeyer Equipment Corp. Elizabeth City, N.C.) charged with 4,175 g of 0.8 mm diameter Yttrium Stabilized Ceramic Media (available from Morimura Bros. (USA), Inc., Torrence, Calif.). The mill was operated at 2500 RPM for 1 minute with water circulating through the jacket of the milling chamber at 80° C. The mill was then cooled to 45° C. and the mixture milled an additional 35 minutes.

A 12.7% (w/w) solids toner concentrate exhibited the following properties as determined using the test methods described above:

Volume Mean Particle Size: 5.12 μm
Q/M: 187 μC/g
Bulk Conductivity: 180 picoMhos/cm
Percent Free Phase Conductivity: 2.39%
Dynamic Mobility: 5.99E-11 ($m^2$/Vsec)

H. Ink Examples with Soluble Polymer-S Added

Example 17-Yellow

Yellow ink from comparative example 8 was mixed with the Soluble Polymer-S from example 3 at a ratio of 9/1 (w/w of solids).

A 14.78% (w/w) solids toner concentrate exhibited the following properties as determined using the test methods described above:

Volume Mean Particle Size: 2.89 μm
Q/M: 172 μC/g
Bulk Conductivity: 175 picoMhos/cm
Percent Free Phase Conductivity: 7.43%
Dynamic Mobility: 4.40E-11 ($m^2$/Vsec)

Example 18-Yellow

Yellow ink from comparative example 12 was mixed with the Soluble Polymer-S from example 3 at a ratio of 9/1 (w/w of solids).

A 14.08% (w/w) solids toner concentrate exhibited the following properties as determined using the test methods described above:

Volume Mean Particle Size: 2.83 μm
Q/M: 236 μC/g
Bulk Conductivity: 349 picoMhos/cm
Percent Free Phase Conductivity: 6.28%
Dynamic Mobility: 5.96E-11 ($m^2$/Vsec)

Example 19-Cyan

Cyan from comparative example 9 was mixed with the Soluble Polymer-S from example 3 at a ratio of 9/1 (w/w of solids).

A 14.34% (w/w) solids toner concentrate exhibited the following properties as determined using the test methods described above:

Volume Mean Particle Size: 2.86 μm
Q/M: 128 μC/g
Bulk Conductivity: 265 picoMhos/cm
Percent Free Phase Conductivity: 3.29%
Dynamic Mobility: 7.21E-11 ($m^2$/Vsec)

Example 20-Cyan

Cyan from comparative example 13 was mixed with the Soluble Polymer-S from example 3 at a ratio of 9/1 (w/w of solids).

A 13.99% (w/w) solids toner concentrate exhibited the following properties as determined using the test methods described above:

Volume Mean Particle Size: 3.68 μm
Q/M: 175 μC/g
Bulk Conductivity: 355 picoMhos/cm
Percent Free Phase Conductivity: 3.04%
Dynamic Mobility: 6.25E-11 ($m^2$/Vsec)

Example 21-Magenta

Magenta from comparative example 10 was mixed with the Soluble Polymer-S from example 3 at a ratio of 9/1 (w/w of solids).

A 14.40% (w/w) solids toner concentrate exhibited the following properties as determined using the test methods described above:

Volume Mean Particle Size: 2.68 μm
Q/M: 288 μC/g
Bulk Conductivity: 354 picoMhos/cm
Percent Free Phase Conductivity: 4.48%
Dynamic Mobility: 6.43E-11 ($m^2$/Vsec)

Example 22-Magenta

Magenta from comparative example 14 was mixed with the Soluble Polymer-S from example 3 at a ratio of 9/1 (w/w of solids).

A 14.13% (w/w) solids toner concentrate exhibited the following properties as determined using the test methods described above:

Volume Mean Particle Size: 2.86 μm
Q/M: 219 μC/g
Bulk Conductivity: 363 picoMhos/cm
Percent Free Phase Conductivity: 3.99%
Dynamic Mobility: 6.93E-11 ($m^2$/Vsec)

Example 23-Black

Black toner from comparative example 11 was mixed with the Soluble Polymer-S from example 3 at a ratio of 9/1 (w/w of solids).

A 13.80% (w/w) solids toner concentrate exhibited the following properties as determined using the test methods described above:

Volume Mean Particle Size: 5.24 μm
Q/M: 217 μC/g
Bulk Conductivity: 306 picoMhos/cm
Percent Free Phase Conductivity: 8.33%
Dynamic Mobility: 9.27E-11 ($m^2$/Vsec)

Example 24-Black

Black toner from comparative example 11 was mixed with the Soluble Polymer-S from example 3 at a ratio of 9/1 (w/w of solids).

A 13.54% (w/w) solids toner concentrate exhibited the following properties as determined using the test methods described above:

Volume Mean Particle Size: 2.81 μm
Q/M: 128 μC/g
Bulk Conductivity: 302 picoMhos/cm
Percent Free Phase Conductivity: 5.62%
Dynamic Mobility: 7.20E-11 ($m^2$/Vsec)

I. Examples of Inks Using Soluble Polymer-P

Example 25-Yellow

Yellow ink from comparative example 8 was mixed with the Soluble Polymer-P of example 4 at a ratio of 9/1 (w/w of solids).

Example 26-Yellow

Yellow ink from comparative example 12 the Soluble Polymer-P of example 4 at a ratio of 9/1 (w/w of solids).

Example 27-Cyan

Cyan from comparative example 9 was mixed with the Soluble Polymer-P of example 4 at a ratio of 9/1 (w/w of solids).

Example 28-Cyan

Cyan from comparative example 13 was mixed with the Soluble Polymer-P of example 4 at a ratio of 9/1 (w/w of solids).

Example 29-Magenta

Magenta from comparative example 10 was mixed with the Soluble Polymer-P of example 4 at a ratio of 9/1 (w/w of solids).

Example 30-Magenta

Magenta from comparative example 14 was mixed with the Soluble Polymer-P of example 4 at a ratio of 9/1 (w/w of solids).

Example 31-Black

Black toner from comparative example 11 was mixed with the Soluble Polymer-P of example 4 at a ratio of 9/1 (w/w of solids).

Example 32-Black

Black toner from comparative example 15 was mixed with the Soluble Polymer-P of example 4 at a ratio of 9/1 (w/w of solids).

Example 33-Black

Black toner from Example 16 was mixed with the Soluble Polymer-P of example 4 at a ratio of 9/1 (w/w of solids).

A 13.2% (w/w) solids toner concentrate exhibited the following properties as determined using the test methods described above:

Volume Mean Particle Size: 4.99 μm
Q/M: 145 μC/g
Bulk Conductivity: 165 picoMhos/cm
Percent Free Phase Conductivity: 5.42%
Dynamic Mobility: 5.14E-11 ($m^2$/Vsec)

The inks of Comparative Examples 8-16 and of Examples 17-33 were subjected to print testing and the optical density of the printed ink was measured as previously described. Accelerated aging test were subsequently carried out as previously described using a Brookfield viscometer. For Examples 26 and 29 a spindle number 2 was used at a speed of 12 (according to the Brookfield viscometer settings). For Examples 31 and 32, a spindle number 2 was used at a speed of 60 (according to the Brookfield viscometer settings). For all other Examples and Comparative Examples, a spindle number 3 was used at a speed of 12 (according to the Brookfield viscometer settings).

TABLE 3

Physical properties, printed optical density, and aging data for Yellow Inks

| Example Number | Organosol D to S Ratio | Additional Component | Volume Average Particle Size μm | Charge per Mass μC/g | Optical Density | Initial visual observations (after stirring) | Visual observations after 3 weeks of acc. aging (after stirring) | Viscosity cP (measured according to test protocol above) |
|---|---|---|---|---|---|---|---|---|
| Comparative Example 8 | 8/1 | None | 2.81 | 160 | 0.48 | Liquid | Soft paste | 1100 |
| Example 17 | 8/1 | S | 2.89 | 172 | 0.89 | Liquid | Soft gel | 1600 |
| Example 25 | 8/1 | P | | Not tested | | Liquid | Soft gel | 650 |
| Comparative Example 12 | 6/1 | None | 2.86 | 212 | 0.70 | Liquid | Gel | 1500 |
| Example 18 | 6/1 | S | 2.83 | 236 | 0.83 | Liquid | Soft gel | 1100 |
| Example 26 | 6/1 | P | | Not tested | | Liquid | Gel | 850 |

TABLE 4

Physical properties, printed optical density, and aging data for Cyan Inks

| Example Number | Organosol D to S Ratio | Additional Component | Volume Average Particle Size μm | Charge per Mass μC/g | Optical Density | Initial visual observations (after stirring) | Visual observations after 3 weeks of acc. aging (after stirring) | Viscosity cP (measured according to test protocol above) |
|---|---|---|---|---|---|---|---|---|
| Comparative Example 9 | 8/1 | None | 2.75 | 145 | 1.30 | Liquid | Gel | 2000 |
| Example 19 | 8/1 | S | 2.86 | 128 | 1.28 | Liquid | Soft gel | 950 |
| Example 27 | 8/1 | P | | Not tested | | Liquid | Soft gel | 900 |
| Comparative Example 13 | 6/1 | None | 3.41 | 207 | 1.22 | Liquid | Soft gel | 2150 |
| Example 20 | 6/1 | S | 3.68 | 175 | 1.12 | Liquid | Liquid | 500 |
| Example 28 | 6/1 | P | | Not tested | | Liquid | Liquid | 500 |

TABLE 5

Physical properties, printed optical density, and aging data for Magenta Inks

| Example Number | Organosol D to S Ratio | Additional Component | Volume Average Particle Size μm | Charge per Mass μC/g | Optical Density | Initial visual observations (after stirring) | Visual observations after 3 weeks of acc. aging (after stirring) | Viscosity cP (measured according to test protocol above) |
|---|---|---|---|---|---|---|---|---|
| Comparative Example 10 | 8/1 | None | 2.58 | 328 | 1.01 | Liquid | Soft paste | 5500 |
| Example 21 | 8/1 | S | 2.67 | 288 | 1.16 | Liquid | Soft gel | 1300 |
| Example 29 | 8/1 | P | | Not tested | | Liquid | Soft gel | 1325 |
| Comparative Example 14 | 6/1 | None | 2.79 | 330 | 1.16 | Liquid | Soft paste | 5300 |
| Example 22 | 6/1 | S | 2.86 | 219 | 1.16 | Liquid | Soft gel | 1700 |
| Example 30 | 6/1 | P | | Not tested | | Liquid | Soft gel | 260 |

TABLE 6

Physical properties, printed optical density, and aging data for Black Inks

| Example Number | Organosol D to S Ratio | Additional Component | Volume Average Particle Size μm | Charge per Mass μC/g | Optical Density | Initial visual observations (after stirring) | Visual observations after 3 weeks of acc. aging (after stirring) | Viscosity cP (measured according to test protocol above) |
|---|---|---|---|---|---|---|---|---|
| Comparative Example 11 | 8/1 | None | 5.28 | 159 | 1.26 | Liquid | Soft gel | 2000 |
| Example 23 | 8/1 | S | 5.24 | 217 | 1.20 | Liquid | Liquid | 400 |
| Example 31 | 8/1 | P | | Not tested | | Liquid | Liquid | 45 |
| Comparative Example 15 | 6/1 | None | 2.76 | 203 | 1.26 | Liquid | Soft gel | 2500 |
| Example 24 | 6/1 | S | 2.81 | 128 | 1.30 | Liquid | Liquid | 400 |
| Example 32 | 6/1 | P | | Not tested | | Liquid | Liquid | 180 |
| Comparative Example 16 | 8/1 | None | 5.11 | 187 | 1.23 | Liquid | Gel | 1600 |
| Example 33 | 8/1 | P | 5.84 | 145 | 1.22 | Liquid | Not tested | |

The information shown in Tables 3, 4, 5, and 6 show that in all cases but one, the incorporation of additional soluble Polymer-S improved the aging stability of the inks. In the case of Example 17, it can be seen that the incorporation of the additional soluble Polymer-S may, in some cases, polymerize and produce a higher viscosity. One reason for this may be the presence of the vinyl groups in the soluble Polymer-S. This phenomenon is dependent upon the nature of the ink composition.

In all cases, the incorporation of additional soluble polymer material improved the aging stability of the inks. Because the soluble polymer component preferably does not contain vinyl groups, it does not have the possibility of polymerizing when it is heated.

The visual observation data as it correlates to the viscosity data is highly composition dependent. One material that appears to be a soft paste may actually go back into solution very easily and have a viscosity that is lower than that of a different composition observed to be a soft gel. The visual observation data should be compared with respect to the subsets of the examples (e.g. Compare a Comparative Example with its counterparts having additional soluble Polymer-S and soluble Polymer-P.

Example 33 shows analytical data for a black ink with additional soluble Polymer-P, indicating that the additional soluble Polymer-P does not negatively impact print performance of the liquid ink.

Other embodiments of this invention will be apparent to those skilled in the art upon consideration of this specification or from practice of the invention disclosed herein. All patents, patent documents, and publications cited herein are incorporated by reference as if individually incorporated. Various omissions, modifications, and changes to the principles and embodiments described herein can be made by one skilled in the art without departing from the true scope and spirit of the invention which is indicated by the following claims.

The invention claimed is:

1. A liquid electrographic toner composition comprising:

a) a liquid carrier having a Kauri-Butanol number less than about 30 mL;

b) a plurality of toner particles dispersed in the liquid carrier, wherein the toner particles comprise polymeric binder comprising at least one amphipathic copolymer comprising one or more S material portions and one or more D material portions; and c) a soluble polymer present in an amount of from about 1% to about 10% by weight based on toner particle weight, wherein the absolute difference in Hildebrand solubility parameters between the soluble polymer and the liquid carrier is less than about 3.0 $MPa^{1/2}$, and wherein the soluble polymer has no more than about 30% weight ratio chemical constitution variance from the chemical constitution of the S material portion of the amphipathic copolymer.

2. The liquid electrographic toner composition of claim 1, wherein the absolute difference in Hildebrand solubility parameters between the soluble polymer and the liquid carrier is less than about 2.0 $MPa^{1/2}$.

3. The liquid electrographic toner composition of claim 1, wherein the absolute difference in Hildebrand solubility parameters between the soluble polymer and the liquid carrier is less than about 1.5 $MPa^{1/2}$.

4. The liquid electrographic toner composition of claim 1, wherein the absolute difference in Hildebrand solubility parameters between the soluble polymer and the liquid carrier is from about 2 to about 3.0 $MPa^{1/2}$.

5. The liquid electrographic toner composition of claim 1, wherein the soluble polymer has a $T_g$ of at least about 30° C.

6. The liquid electrographic toner composition of claim 1, wherein the soluble polymer has a $T_g$ of at least about 45° C.

7. The liquid electrographic toner composition of claim 1, wherein the soluble polymer has a $T_g$ of at least about 60° C.

8. The liquid electrographic toner composition of claim 1, wherein the soluble polymer has a molecular weight of from about 50,000 to about 500,000 Daltons.

9. The liquid electrographic toner composition of claim 1, wherein the soluble polymer comprises a reactive functionality.

10. The liquid electrographic toner composition of claim 1, wherein the soluble polymer does not comprise a reactive functionality.

11. The liquid electrographic toner composition of claim 1, wherein the soluble polymer is substantially free of reactive vinyl groups.

12. The liquid electrographic toner composition of claim 1, wherein the soluble polymer has no more than about 20% by weight ratio chemical constitution variance from the chemical constitution of the S material portion of the amphipathic copolymer.

13. The liquid electrographic toner composition of claim 1, wherein the soluble polymer has no more than about 10% by weight ratio chemical constitution variance from the chemical constitution of the S material portion of the amphipathic copolymer.

14. The liquid electrographic toner composition of claim 1, wherein the difference between the molecular weight of the soluble polymer and of the S material portion of the amphipathic copolymer is no more than about 50%.

15. The liquid electrographic toner composition of claim 1, wherein the difference between the molecular weight of the soluble polymer and of the S material portion of the amphipathic copolymer is no more than about 30%.

16. The liquid electrographic toner composition of claim 1, wherein the difference between the molecular weight of the soluble polymer and of the S material portion of the amphipathic copolymer is no more than about 10%.

17. The liquid electrographic toner composition of claim 1, wherein the soluble polymer and the S material portion of the amphipathic copolymer have no more than about a 30% weight ratio chemical constitution variance and no more than about a 50% molecular weight variance.

18. The liquid electrographic toner composition of claim 1, wherein the soluble polymer and the S material portion of the amphipathic copolymer have no more than about a 20% weight ratio chemical constitution variance and no more than about a 30% molecular weight variance.

19. The liquid electrographic toner composition of claim 1, wherein the soluble polymer and the S material portion of the amphipathic copolymer have no more than about a 10% weight ratio chemical constitution variance and no more than about a 10% molecular weight variance.

20. The liquid electrographic toner composition of claim 1, wherein the soluble polymer and the S material portion of the amphipathic copolymer are both (meth)acrylate based moieties.

21. The liquid electrographic toner composition of claim 1, wherein the soluble polymer is made from (meth)acrylate based moieties and comprises moieties selected from the group consisting of trimethyl cyclohexyl methacrylate; t-butyl methacrylate; n-butyl methacrylate; isobornyl (meth) acrylate; 1,6-Hexanediol di(meth)acrylate; 2-hydroxyethyl methacrylate; dimethyl-m-isopropenyl benzyl isocyanate; and combinations thereof.

22. The liquid electrographic toner composition of claim 1, wherein the soluble polymer is made from (meth)acrylate based moieties and comprises trimethyl cyclohexyl methacrylate, 2-hydroxyethyl methacrylate and dimethyl-m-isopropenyl benzyl isocyanate.

23. The liquid electrographic toner composition of claim 1, wherein the soluble polymer is a homopolymer made from trimethyl cyclohexyl methacrylate.

* * * * *